US010089967B2

(12) United States Patent
Clissold

(10) Patent No.: US 10,089,967 B2
(45) Date of Patent: Oct. 2, 2018

(54) KEY MEMBER FOR A MUSICAL INSTRUMENT

(71) Applicant: NUVO INSTRUMENTAL (ASIA) LTD, Kennedy Town (CN)

(72) Inventor: Maximilian Spencer Clissold, Kennedy Town (CN)

(73) Assignee: NUVO INSTRUMENTAL (ASIA) LTD, Kennedy Town, Hong Kong (CN)

( * ) Notice: Subject to any disclaimer, the term of this patent is extended or adjusted under 35 U.S.C. 154(b) by 0 days.

(21) Appl. No.: 15/514,346

(22) PCT Filed: Sep. 23, 2015

(86) PCT No.: PCT/CN2015/090472
§ 371 (c)(1),
(2) Date: Mar. 24, 2017

(87) PCT Pub. No.: WO2016/045594
PCT Pub. Date: Mar. 31, 2016

(65) Prior Publication Data

US 2017/0243570 A1 Aug. 24, 2017

(30) Foreign Application Priority Data

Sep. 25, 2014 (HK) ..... 14109642.7

(51) Int. Cl.
*G10D 9/04* (2006.01)
*G10D 7/02* (2006.01)
*G10D 7/06* (2006.01)

(52) U.S. Cl.
CPC ..... *G10D 9/04* (2013.01); *G10D 7/02* (2013.01); *G10D 7/06* (2013.01)

(58) Field of Classification Search
CPC ..... G10D 9/04
See application file for complete search history.

(56) References Cited

U.S. PATENT DOCUMENTS 3,375,746 A * 4/1968 Proll ..... G10D 9/043 446/208
3,688,633 A * 9/1972 Nagao ..... G10D 9/043 84/380 R (Continued)

FOREIGN PATENT DOCUMENTS

CN 1621701 6/2005
CN 201965899 U 9/2011

(Continued)

OTHER PUBLICATIONS

International Search Report and Written Opinion.
UK Intellectual Property Office Patentability Search Report.

*Primary Examiner* — Robert W Horn
(74) *Attorney, Agent, or Firm* — Joseph G. Chu; JCIP

(57) ABSTRACT

A keyed wind musical instrument (100, 101, 102) including an elongate tubular body (200) having a plurality of tone holes (201) extending through a surface of the elongate tubular body (200); at least one key member (202) attached to the elongate tubular body (200) adjacent at least one of said plurality of tone holes (201), the at least one key member (202) including: a closure portion (202B) movable between at least one of a closed configuration in which the closure portion (202B) substantially seals the tone hole (201), and, an opened configuration in which the closure portion (202B) is spaced apart from the tone hole (201) wherein the tone hole (201) is opened; and an attachment portion (202A) integrally formed with the closure portion (202B), the attachment portion (202A) being configured for attaching the key member (202) to the elongate tubular body (200); and wherein the integrally formed attachment portion (202A) and closure portion (202B) are configured to bias the closure portion (202B) towards the opened configuration.

19 Claims, 3 Drawing Sheets

(56) References Cited

U.S. PATENT DOCUMENTS

| | | | | |
|---|---|---|---|---|
| 5,027,685 | A * | 7/1991 | Lenz | G10D 7/005 84/330 |
| D770,561 | S * | 11/2016 | Clissold | D17/10 |
| 9,558,725 | B2 * | 1/2017 | Uesawa | G10D 9/043 |
| 2017/0243570 | A1 * | 8/2017 | Clissold | G10D 9/04 |

FOREIGN PATENT DOCUMENTS

| | | | |
|---|---|---|---|
| CN | 102760422 | | 10/2012 |
| DE | 3438618 | A1 | 2/1986 |
| DE | 4206852 | A1 | 9/1993 |
| WO | 0014718 | A1 | 3/2000 |

* cited by examiner

KEY MEMBER FOR A MUSICAL INSTRUMENT

TECHNICAL FIELD

The present invention relates to the field of musical instruments.

BACKGROUND OF THE INVENTION

Traditionally, musical instruments such as the recorder have been used as an introductory musical instrument typically for children from ages 3 to 8 to develop their musicality. Whilst introductory musical instruments such as the recorder have been well received in early music education, it is difficult for a child's finger to fully cover and seal a tone hole of an instrument such as the recorder given that a child's finger may typically be as little as 5 mm across (as opposed to 20 mm for a fully grown adult) whereas the tone hole of the musical instrument to be covered may be at least 6 mm in diameter or larger. Accordingly, as a child may not be able to accurately position his finger over and seal the tone hole, the recorder will produce an unpleasant "screeching" sound having an incorrect pitch. This may also cause frustration for the child and the teacher and may vastly compromise the child's musical learning experience.

In seeking to alleviate this problem, certain existing instruments include tone holes with reduced size so as to enable a child's finger to more accurately cover and seal the tone hole. However, the reduced tone hole diameter results in a relatively "muted" tone which is perceived to lack desirable tone resonance and tone projection quality. The reduction in the tone hole size may also require repositioning of the tone hole in order to maintain the correct pitch. However, this may compromise the instrument ergonomically because a child may need to stretch or contort the natural positioning of his/her fingers on the instrument making it more difficult to play.

SUMMARY OF THE INVENTION

The present invention seeks to alleviate at least one of the above-described problems.

The present invention may involve several broad forms. Embodiments of the present invention may include one or any combination of the different broad forms herein described.

In a first broad form, the present invention provides a keyed wind musical instrument including:

an elongate tubular body having a plurality of tone holes extending through a surface of the elongate tubular body;

at least one key member attached to the elongate tubular body adjacent at least one of said plurality of tone holes, the at least one key member including:

a closure portion movable between at least one of a closed configuration in which the closure portion substantially seats the tone hole, and, an opened configuration in which the closure portion is spaced apart from the tone hole wherein the tone hole is opened; and an attachment portion integrally formed with the closure portion, the attachment portion being configured for attaching the key member to the elongate tubular body; and wherein the integrally formed attachment portion and closure portion are configured to bias the closure portion towards the opened configuration.

Preferably, the closure portion and the attachment portion of the key member may be integrally formed from at least one of a polymeric, co-polymeric, and polymeric composite material.

Preferably, the closure portion and the attachment portion may be integrally formed from an elastomeric material. Also preferably, the closure portion and the attachment portion may be integrally formed from at least one of silicone and a silicone-based polymeric material.

Preferably, the key member may be configured for removable attachment to the elongate tubular body.

Preferably, the present invention may include at least one location hole disposed in the attachment portion configured for receiving a corresponding locating pin extending from the elongate tubular body when the attachment portion attaches the key member to the elongate tubular body.

Preferably, an aperture may extend through the closure portion, the aperture being sized and dimensioned such that when in the closed configuration, the aperture is aligned over the tone hole whereby a half-note is able to be played.

Preferably, the at least one key member may include a plurality of closure portions configured for substantially sealing a plurality of tone holes disposed on the elongate tubular body when arranged in the closed configuration.

Preferably, the present invention may include a woodwind instrument. Also preferably, the woodwind instrument may include at least one of a flute, a piccolo, and a recorder. Also typically, the present invention may include at least one of a single-reed musical instrument and a double-reed musical instrument. Also preferably, the single-reed or double-reed musical instrument may include at least one of a clarinet, an oboe, a bassoon, a saxophone, a piccolo saxophone, a tenor saxophone, an alto saxophone, and a baritone saxophone.

Preferably, the plurality of tone holes may include diameters approximately in the range of between 4 mm-50 mm.

Preferably, the aperture extending through the closure portion may be include a diameter approximately in the range of between 2 mm-6 mm.

In a second broad form, the present invention provides a key member for use with a musical instrument having an elongate tubular body and a plurality of tone holes extending through a surface of the elongate tubular body, wherein the key member includes:

an attachment portion configured for attaching the key member to the elongate tubular body adjacent one of the plurality of tone holes;

a closure portion integrally formed with the attachment portion, the closure portion being movable between at least one of a closed configuration in which the closure portion substantially seals the tone hole, and, an opened configuration in which the closure portion is spaced apart from the tone hole wherein the tone hole is opened; and wherein the integrally formed attachment portion and closure portion are configured to bias the closure portion towards the opened configuration.

Preferably, the closure portion and the attachment portion of the key member may be integrally formed from at least one of a polymeric, co-polymeric, and polymeric composite material.

Preferably, the closure portion and the attachment portion may be integrally formed from an elastomeric material. Also preferably, the closure portion and the attachment portion may be integrally formed from at least one of silicone and a silicone-based polymeric material.

Preferably, the key member may be configured for removable attachment to the elongate tubular body.

Preferably, the present invention may include at least one location hole disposed in the attachment portion configured for receiving a corresponding locating pin extending from the elongate tubular body when the attachment portion attaches the key member to the elongate tubular body.

Preferably, an aperture may extend through the closure portion, the aperture being sized and dimensioned such that when in the closed configuration, the aperture is aligned over the tone hole whereby a half-note is able to be played.

Preferably, the at least one key member may include a plurality of closure portions which may be configured for substantially seating a plurality of tone holes disposed on the elongate tubular body when arranged in the closed configuration.

Preferably, the present invention may include a woodwind instrument. Also preferably, the woodwind instrument may include at least one of a flute, a piccolo, and a recorder. Also typically, the present invention may include at least one of a single-reed musical instrument and a double-reed musical instrument. Also preferably, the single-reed or double-reed musical instrument may include at least one of a clarinet, an oboe, a bassoon, a saxophone, a piccolo saxophone, a tenor saxophone, an alto saxophone, and a baritone saxophone.

Preferably, the plurality of tone holes may include diameters approximately in the range of between 4 mm-50 mm.

Preferably, the aperture extending through the closure portion may be include a diameter approximately in the range of between 2 mm-6 mm.

Accordingly, the present invention may provide at least one of the following advantages:

(i) The key members are configured such that they provide suitable responsiveness, as well as ease and accuracy of operation by a child's finger in opening and closing the tone holes in comparison to a child's finger having to be utilised to directly seal and open the tone holes. Accordingly, a child is able to concentrate upon developing musicality and enjoy this process without being distracted by the need to accurately position his finger on the tone hole during playing of the instrument.

(ii) As the key members provide ease and accuracy of operation by a child's finger in opening and closing the tone holes, the tone holes may be suitably sized to provide improved tone protection and resonance. In contrast, certain existing products are deliberately designed with relatively smaller tone hole diameters to allow for ease and accuracy of direct covering by a child's finger but at the cost of sacrificing tone projection and resonance quality;

(iii) As the key members may be integrally formed, for instance from an elastomeric polymeric material such as silicone, suitable biasing and closure functionality may be inherently provided by virtue of the material and structure of the integrally formed key member. Furthermore, as the key members of the present invention may be integrally formed from a material such as silicone the key members may be relatively durable and water proof. In contrast, key assemblies as may typically be found on clarinets, flutes and saxophones, require relatively complex and relatively expensive multi-component and multi-material assemblies and structures (i.e. including hinges, springs, felt sealing pads formed form disparate materials). As such, the present invention presents a notable advantage over key assemblies of existing instruments which are more susceptible to damage due to the complexity of the key assembly, and require greater cost and complexity to produce, maintain and repair;

(iv) The ease of removal and replacement of key members of the present invention provides for lower cost of production, maintenance and repair. Furthermore, the key members of the present invention may be customizable so to suit the user's specific tastes and requirements;

BRIEF DESCRIPTION OF THE DRAWINGS

The present invention will become more fully understood from the following detailed description of a preferred but non-limiting embodiment thereof, described in connection with the accompanying drawings, wherein.

DETAILED DESCRIPTION OF THE PREFERRED EMBODIMENTS

Figure 1:
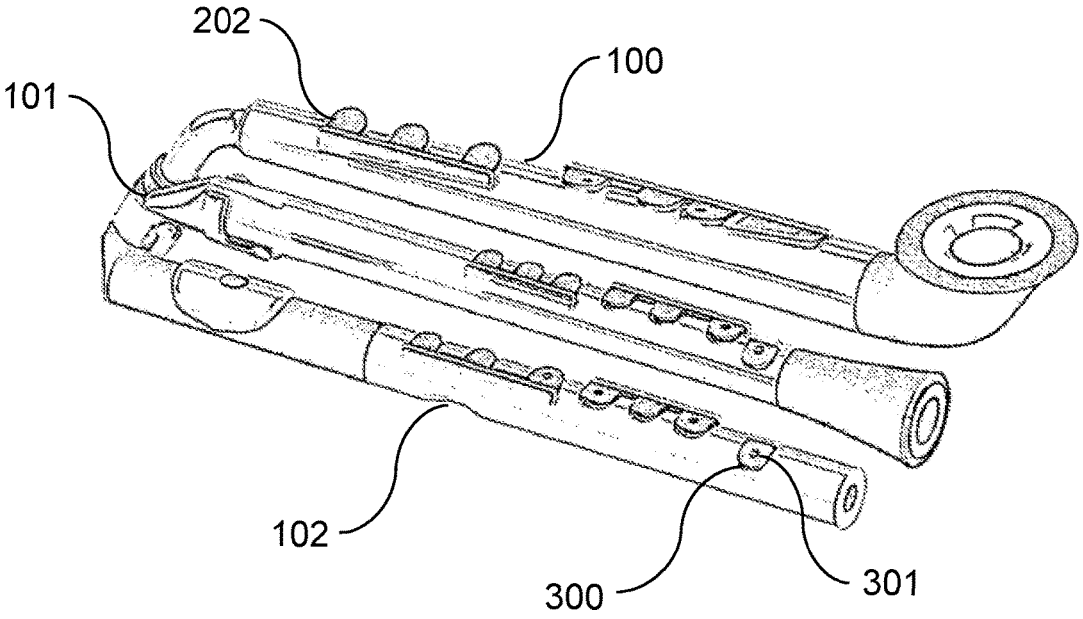
FIG. 1 depicts exemplary embodiments of the present invention in the form of a saxophone, a recorder and a flute having integrally formed silicone key members disposed thereon for covering tone holes.

Preferred embodiments of the present invention and advantages will now be described herein by reference to FIGS. 1 to 3B of the drawings. By way of example, embodiments of the present invention may be implemented in the form of a saxophone type instrument configuration (100), a clarinet-type instrument having a single-reed configuration (101), and, a flute-type instrument having a cross-blowing lip plate (102) as shown in FIG. 1.

In embodiments of the present invention an elongate tubular body (200) is provided having a plurality of tone holes (201) extending through the surface of the elongate tubular body (200). The elongate tubular body (200) may for instance be molded from a resin material or any other suitable material. The tone holes (201) in the exemplary embodiments may typically include diameters approximately in the range of between 4 mm-10 mm depending upon the type of instrument implemented. In certain embodiments, such as where a saxophone-type instrument is implemented, the tone holes may be up to around 50 mm in diameter.

The preferred embodiments also include a plurality of key members (202) corresponding to each of the tone holes (201). The key members (202) each include an attachment portion (202A) and a closure portion (202B) which are integrally molded from an elastomeric polymeric material such as silicone or a silicone-based material. It is possible in certain embodiments for the key members to be formed from a suitably shaped and dimensioned co-polymeric material, polymeric composite material, or a non-polymeric material.

Figure 2:
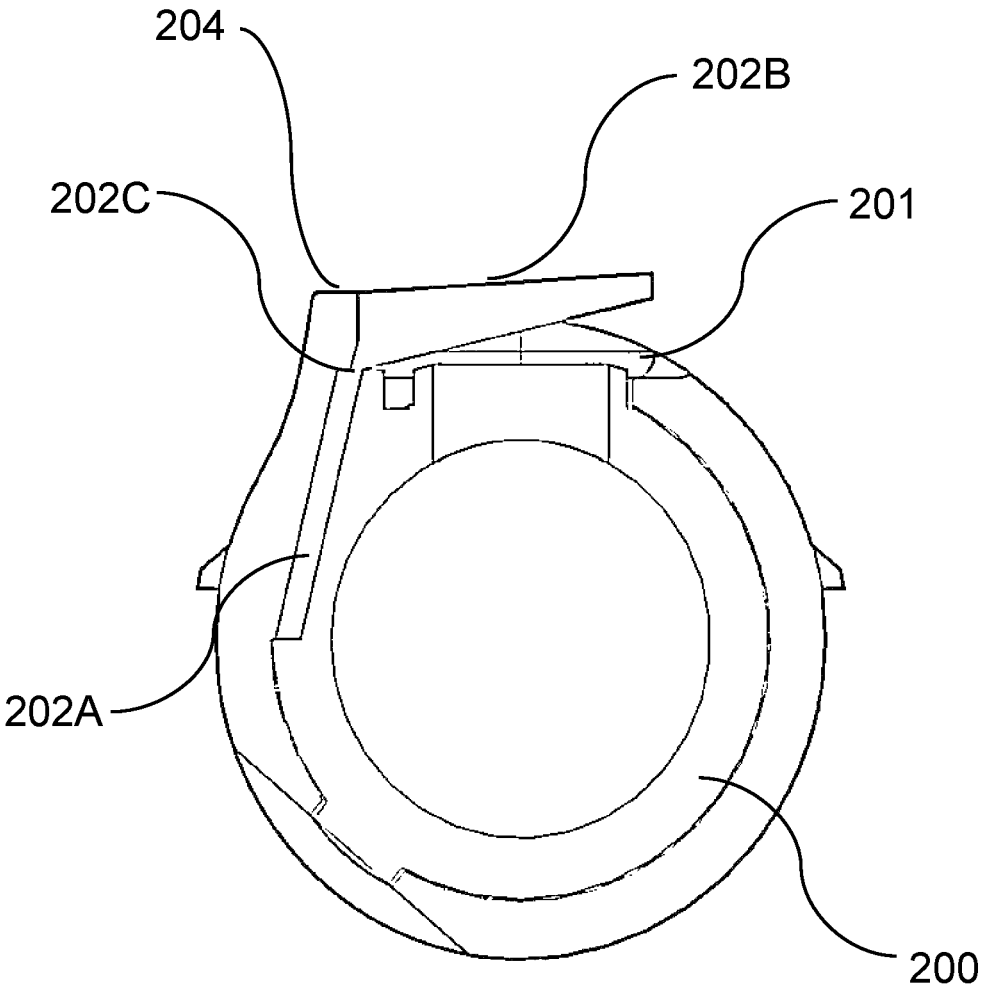
FIG. 2 depicts a cross-sectional cut-away view of an elongate tubular body of a first embodiment recorder whereby an integrally formed key member is attached to the elongate tubular body of the recorder.
Figure 3A:
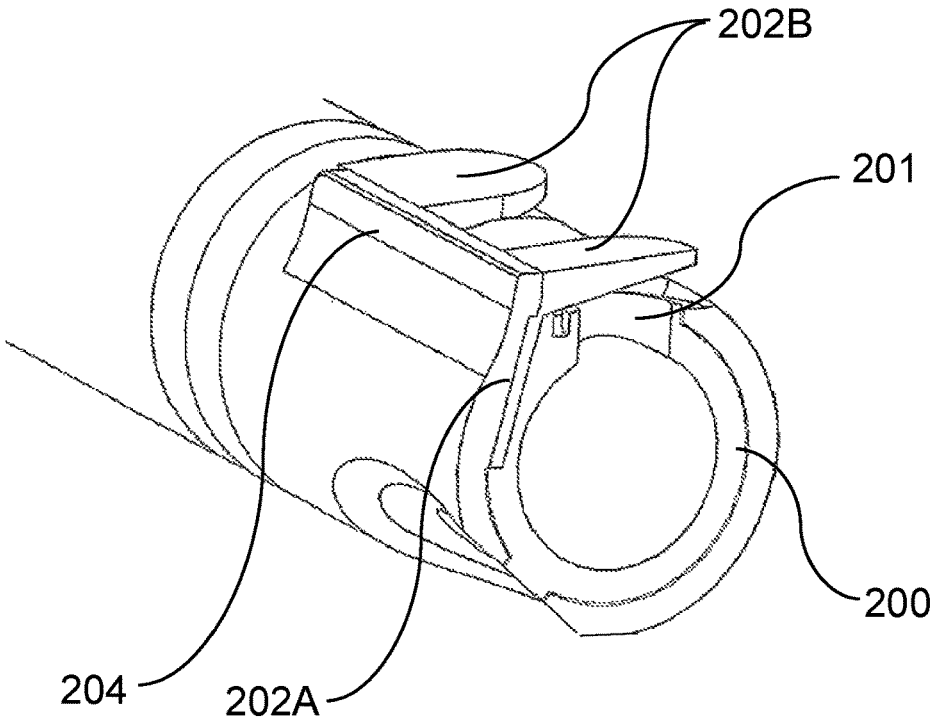
FIG. 3A depicts a perspective cut-away view of the first embodiment recorder in FIG. 2 in which a stopper plate is releasably engaged to the elongate tubular body to assist in holding the integrally formed key member attached to the elongate tubular body.
Figure 3B:
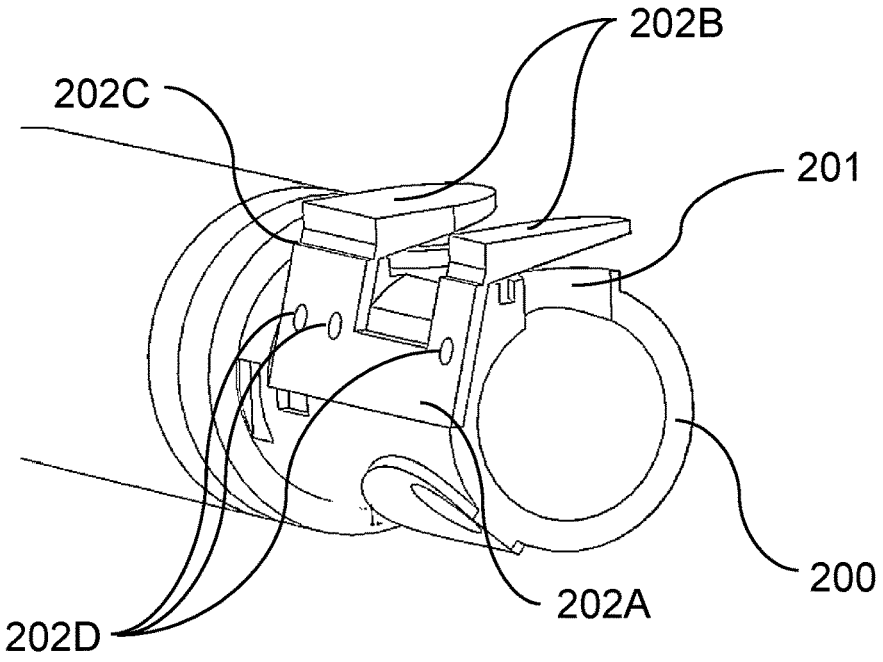
FIG. 3B depicts a perspective cut-away view of the first embodiment recorder in FIG. 2 with the stopper plate detached whereby the location pins of the elongate tubular member are received within location holes of the integrally formed key member.

The attachment portions (202A) of the key members (202) include locating holes (202D) disposed therein which are configured to receive corresponding locating pins extending from the elongate tubular body (200) so as to locate the key members (202) in fixed positions on the elongate tubular body (200) adjacent to their corresponding tone holes (201). Key members (202) are further held in place by a stopper plate (204) which are configured for releasable attachment with the elongate tubular body (200) by for instance friction-fitting engagement. The stopper plate (204), when releasably engaged with the elongate tubular body (200), sandwiches the attachment portion (202A) of the key member (202) securely in place against the outer surface of the elongate tubular body (200) such as is shown in FIGS. 2 and 3A. In alternate embodiments, the attachment portion (202A) could be attached to the elongate tubular body (200) by any other suitable manner of attachment including for instance an adhesive attachment, screwed-in attachment and clamped attachment.

Conveniently, key members (202) are able to be selectably removed for maintenance or replaced entirely when worn out simply by urging the stopper plate (204) away from the elongate tubular body (200) to release the stopper plate (204) from the elongate tubular body (200) and then sliding the key member (202) of the locating pins. In certain embodiments, key members (202) may be provided in a selection of different colours such that a user may conveniently customise the coloured key members (202) that are attached to the elongate tube member. Colour customisation of key members (202) may be useful as a visual learning aid for a child who may more readily remember the key to be operated during playing of the instrument. In yet alternate embodiments, key members (202) may include indicia visible to the user which may represent a musical note corresponding to the tone hole that the key member is configured to cover. Replacement key members (202) may also be provided of variable shapes and dimensions in seeking to accommodate a range of different user finger shapes and sizes.

The closure portions (202B) of the key members (200) are pivotably movable relative to the attachment portions (202A) around a pivot region (202C) between at least one of a closed configuration in which the closure portion substantially seals the corresponding tone hole (201), and, an opened configuration in which the closure portion (202B) is spaced apart from the tone hole (201) wherein the tone hole (201) is opened. The material and shape/dimensioning of the closure portion (202B) allows the corresponding tone hole (201) to be accurately and firmly sealed by the closure portion (202B) when arranged in the closed configuration. By way of comparison, multi-component/multi-material key assemblies of existing instruments such as flutes and the like may typically utilise felt pads disposed on the keys to contact with the rim of the tone hole to seal the tone hole. However, over time, felt-pads tend to deteriorate and compress to the point where their ability to provide a tight seal over the tone hole is compromised. Additionally, deterioration and compression of the felt-pads on keys of existing instruments tends to result in a loss of tactile feel and responsiveness experienced by the user.

The integrally formed attachment portion (202A) and closure portion (202B) are configured such that the closure portion (202B) is biased towards the opened configuration when attached to the elongate tubular body (200). In these preferred embodiments, the inherent biasing of the key member when at rest is provided by virtue of the material used to form the key member (202), in this case being silicone, and the structure of the key member (202). When a user presses downward on a given key member (202), the key member (202) substantially seals the tone hole (thereby changing the pitch of the instrument) to allow playing of a note. When the user releases his finger from the key member (202), the key member (202) is urged back to the opened configuration by its inherent biasing. The properties (including density and hardness) of the silicone used to integrally form the key member (202) is selected so as to allow for suitable responsiveness of the key member (202) in being able to rapidly seal and open the tone hole (201) during playing of the instrument. Conveniently, this responsiveness of the key members (202) facilitates playing of a "trill" on the instrument.

The stopper plate (204) is configured to assist in maintaining the closure portion (202B) at a fixed clearance of approximately 4.5 mm from the tone hole (201) when arranged in the opened configuration. This clearance is considered to provide suitable sound projection and accuracy of pitch when the tone hole (201) is opened during playing of the instrument. In certain embodiments, the stopper plate (204) need not assist in maintaining the closure portion (202B) at the fixed clearance distance and the fixed clearance distance may be achieved simply by selectively configuring the shape and dimensions of the key member (202) itself.

As shown, the structure of the key members (202) may also be integrally formed with either a single closure portion configured for covering a single tone hole (201), or, a plurality of integrally formed closure portions which are configured to cover a plurality of tone holes (201) when pressure is applied to the key member (202) by a user's finger(s). For instance, in FIG. 3B, a key member (202) is shown with integrally formed from silicone with multiple closure portions configured for covering adjoining tone holes (201).

Certain half-note key members (300) such as is shown in FIG. 1 may include an aperture (301) extending therethrough which allows for half-notes to be played using the instrument. The aperture (301) is sized and dimensioned such that when arranged in the closed configuration, the aperture (301) is aligned over the tone hole (201) whereby a half-note is able to be played. The aperture (301) extending through the closure portion may for instance include a diameter approximately in the range of between 2 mm-6 mm.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A keyed wind musical instrument including:

an elongate tubular body having a plurality of tone holes extending through a surface of the elongate tubular body;

at least one key member attached to the elongate tubular body adjacent at least one of said plurality of tone holes, the at least one key member including:

a closure portion movable between at least one of a closed configuration in which the closure portion substantially seals the tone hole, and, an opened configuration in which the closure portion is spaced apart from the tone hole wherein the tone hole is opened; and an attachment portion configured for attaching the key member to the elongate tubular body; and wherein the attachment portion and the closure portion of the key member are integrally molded together as a single piece of silicone or silicon-based polymeric material and comprising a substantially V-shaped cross-section to effect biasing of the closure portion towards the opened configuration.

2. The keyed wind musical instrument as claimed in claim 1 wherein the closure portion and the attachment portion of the key member are integrally formed from at least one of a polymeric, co-polymeric, and polymeric composite material.

3. The keyed wind musical instrument as claimed in claim 1 wherein the closure portion and the attachment portion are integrally formed from an elastomeric material.

4. The keyed wind musical instrument as claimed in claim 1 wherein the key member is configured for removable attachment to the elongate tubular body.

5. The keyed wind musical instrument as claimed in claim 1 including at least one location hole disposed in the attachment portion configured for receiving a corresponding locating pin extending from the elongate tubular body when the attachment portion attaches the key member to the elongate tubular body.

6. The keyed wind musical instrument as claimed in claim 1 including an aperture extending through the closure portion, the aperture being sized and dimensioned such that when in the closed configuration, the aperture is aligned over the tone hole whereby a half-note is able to be played.

7. The keyed wind musical instrument as claimed in claim 1 wherein the at least one key member includes a plurality of closure portions configured for substantially sealing a plurality of tone holes disposed on the elongate tubular body when arranged in the closed configuration.

8. The keyed wind musical instrument as claimed in claim 1 including a woodwind instrument.

9. The keyed wind musical instrument as claimed in claim 1 wherein the plurality of tone holes include diameters approximately in the range of between 4 mm-50 mm.

10. The keyed wind musical instrument as claimed in claim 6 wherein the aperture extending through the closure portion may include a diameter approximately in the range of between 2 mm-6 mm.

11. A key member for use with a musical instrument having an elongate tubular body and a plurality of tone holes extending through a surface of the elongate tubular body, wherein the key member includes:

an attachment portion configured for attaching the key member to the elongate tubular body adjacent one of the plurality of tone holes;

a closure portion configured for movement between at least one of a closed configuration in which the closure portion substantially seals the tone hole, and, an opened configuration in which the closure portion is spaced apart from the tone hole wherein the tone hole is opened; and wherein the attachment portion and the closure portion of the key member are integrally molded together as a single piece of silicone or silicone-based polymeric material and comprising a substantially V-shaped cross-section to effect biasing of the closure portion towards the opened configuration.

12. The key member as claimed in claim 11 wherein the closure portion and the attachment portion are integrally formed from at least one of a polymeric, co-polymeric, and polymeric composite material.

13. The key member as claimed in claim 11 wherein the closure portion and the attachment portion are integrally formed from an elastomeric material.

14. The key member as claimed in claim 11 wherein the key member is configured for removable attachment to the elongate tubular body.

15. The key member as claimed in claim 11 including at least one location hole disposed in the attachment portion configured for receiving a corresponding locating pin extending from the elongate tubular body when the attachment portion attaches the key member to the elongate tubular body.

16. The key member as claimed in claim 11 including an aperture extending through the closure portion, the aperture being sized and dimensioned such that when in the closed configuration, the aperture is aligned over the tone hole whereby a half-note is able to be played.

17. The key member as claimed in claim 11 wherein the at least one key member includes a plurality of closure portions configured for substantially sealing a plurality of tone holes disposed on the elongate tubular body when arranged in the closed configuration.

18. The key member as claimed in claim 11 wherein the plurality of tone holes include diameters approximately in the range of between 4 mm-50 mm.

19. The key member as claimed in claim 16 wherein the aperture extending through the closure portion may include a diameter approximately in the range of between 2 mm-6 mm.

* * * * *